US009758221B2

(12) United States Patent
Harrington et al.

(10) Patent No.: US 9,758,221 B2
(45) Date of Patent: Sep. 12, 2017

(54) SPORT HARNESS

(71) Applicant: Ocean Rodeo Sports Inc., Victoria (CA)

(72) Inventors: Ross Harrington, Victoria (CA); Richard K. Myerscough, Victoria (CA); Anton Rudolf Enserink, Dordrecht (NL)

(73) Assignee: Ocean Rodeo Sports Inc., Victoria, BC (CA)

( * ) Notice: Subject to any disclaimer, the term of this patent is extended or adjusted under 35 U.S.C. 154(b) by 0 days.

(21) Appl. No.: 14/916,195

(22) PCT Filed: Sep. 3, 2014

(86) PCT No.: PCT/CA2014/000666
§ 371 (c)(1),
(2) Date: Mar. 3, 2016

(87) PCT Pub. No.: WO2015/031977
PCT Pub. Date: Mar. 12, 2015

(65) Prior Publication Data

US 2016/0221649 A1 Aug. 4, 2016

Related U.S. Application Data

(60) Provisional application No. 61/873,056, filed on Sep. 3, 2013.

(51) Int. Cl.
*B63H 9/00* (2006.01)
*B63B 35/79* (2006.01)
(Continued)

(52) U.S. Cl.
CPC ..... *B63B 35/7979* (2013.01); *A63C 5/11* (2013.01); *B63B 35/7993* (2013.01); *B63H 2009/0692* (2013.01)

(58) Field of Classification Search
CPC ..... B63B 35/7979
(Continued)

(56) References Cited

U.S. PATENT DOCUMENTS 4,112,865 A * 9/1978 Carn ..... B63B 35/7993 114/39.18
4,452,161 A * 6/1984 McCoy ..... B63B 35/7993 114/39.18
(Continued)

FOREIGN PATENT DOCUMENTS

DE 20 2004 006 143 U1 8/2004
WO 2012/172581 A1 12/2012

OTHER PUBLICATIONS

International Search Report Corresponding to PCT/CA2014/000666 mailed Dec. 11, 2014.
(Continued)

*Primary Examiner* — Daniel V Venne
(74) *Attorney, Agent, or Firm* — Davis & Bujold PLLC; Michael J. Bujold

(57) ABSTRACT

A sport harness for use with a kite or other propulsive device having a quick release feature whereby the user may release himself or herself from the harness while being pulled by a kite. The quick release feature including an interconnection between a spreader bar and one part of a two part waist band closure whereby releasing one end of the spreader bar causes the closure to separate. A harness having vent openings. An overlay for impeding tangling of lines with a harness.

8 Claims, 12 Drawing Sheets

(51) Int. Cl.
*A63C 5/11* (2006.01)
*B63H 9/06* (2006.01)

(58) Field of Classification Search
USPC ..... 114/39.16, 39.18; 244/151 R, 155 A, 244/155 R
See application file for complete search history.

(56) References Cited

U.S. PATENT DOCUMENTS 4,508,045 A * 4/1985 Spanier ..... B63B 35/7996 114/39.18
4,630,563 A * 12/1986 Pertramer ..... B63B 35/7993 114/39.16
4,745,870 A * 5/1988 Roth ..... B63B 35/7993 114/39.18
4,763,591 A * 8/1988 Taylor ..... B63B 35/7996 114/39.18
5,134,951 A * 8/1992 Nishimura ..... B63B 35/7996 114/39.18
5,449,309 A * 9/1995 McCarty ..... B63B 35/815 114/253
5,823,129 A * 10/1998 Barnes, Jr. ..... B63B 35/7933 114/39.16
6,293,215 B1 * 9/2001 Moorrees ..... B63B 35/7993 114/39.18
7,182,294 B2 * 2/2007 Blackman ..... B63B 35/7979 244/155 A
7,992,506 B1 * 8/2011 Patton ..... B63B 35/7979 114/39.18
2002/0088385 A1 * 7/2002 Thompson ..... B63B 35/7979 114/39.16
2006/0046589 A1 * 3/2006 Farley ..... B63B 35/79 441/108
2012/0292129 A1 * 11/2012 Seman ..... A62B 35/0006 182/9

OTHER PUBLICATIONS

Written Opinion Corresponding to PCT/CA2014/000666 mailed Dec. 11, 2014.

* cited by examiner

SPORT HARNESS

CROSS REFERENCE TO RELATED APPLICATIONS

This application claims the benefit of U.S. Application No. 61/873,056, filed 3 Sep. 2013.

FIELD OF THE INVENTION

The present invention relates to the field of sport harnesses, more particularly, sport harnesses to connect a user to a propulsive device, for example a propulsive wing or sport traction kite (also referred to as a power kite).

BACKGROUND OF THE INVENTION

A power kite or traction kite is a relatively large foil-type kite intended to provide a pulling force to the user. Traction kites can be used to sail upwind under the same principles as used by other sailing craft. Several kite sailing sports have become popular, such as kite buggying, kite landboarding, kite boating, kite surfing and snow kiting. Traction kites used in water sports typically have inflatable leading edges or supported leading edges, so that they do not sink or collapse on contact with the water.

In use, traction kites generally need to be continuously manipulated by the user in order to control the flying trajectory of the kite to generate the required traction, to handle wind gusts and to keep the kite from descending to the ground.

For smaller crafts, like buggies, surfboards and dinghies, a traction kite can generally be controlled by hand. One common way of manipulating a traction kite is by means of a 3-point control system, where one centrally placed "power" line bears the main load of the kite, and two control lines are manipulated to sheet in and sheet out the flexible left and right tips of the kite. In a common kite setup, the centrally placed line branches out towards the kite to multiple connection points at the leading edge of the kite. The other end of the centrally placed line attaches to a structural part of the craft, or, in the case of surf-style kiting where the rider stands on a wheeled or sliding board, the centrally placed, load bearing line attaches to a fixed point (e.g., a spreader hook) on a harness worn by the rider, and the two control lines attach to the ends of a control bar located so as to be manipulable by a rider wearing the harness. In this arrangement, the force generated by the kite is applied to the harness worn by the rider.

The control bar used to steer and sheet the kite often features a central hole through which the central load bearing line passes. By moving the control bar along the load bearing line in a direction away from the fixed point on the rider's harness, the tips of the kite are "sheeted" out, spilling wind from the kite. By sliding the moving the bar towards the fixed point on the rider's harness, the tips of the kite are sheeted in, causing the kite to spill less wind and thus to "power up". Pulling one end of the control bar more than the other end will cause the kite to sheet in on the side pulled in, and to sheet out on the other side, causing the kite to tend to turn about the sheeted in side.

The range of movement of the control bar along the central load bearing line is limited by the assembly that attaches to the rider's harness, typically a loop of strong line covered in PU tubing that hooks onto a spreader bar/hook assembly mounted on the front of the rider's harness. This spreader bar/hook assembly is the primary power/force load point between the rider and the kite. The rider's arms and hands are primarily used to provide control turn input into the kite control bar so as to provide turn and sheeting input to the kite, and generally are subjected to only a relatively small portion of the pulling force imparted by the kite.

It is desirable for the harnesses worn by kite riders to be strong, comfortable and securely fitted, to enable proper control of the kite. Typically, such harnesses includes a generally flexible waist belt (or waist band) secured about the rider and are configured such that a generally rigid spreader bar/hook assembly may be attached to the harness at the rider's front.

For comfort (primarily in terms of spreading loads on the rider's body), harnesses typically have foam padding and reinforcing in the form of strong fabrics and webbing. Known harnesses have several different fitting and tightening adjustment means. A common adjustment means for a waist belt is an overlapping wrap closure at the harness front, with the overlapping ends of the waist belt secured one to the other with a conventional hook and loop fastener (e.g., Velcro™). Locating the overlapping ends of the waist belt at the rider's front provides desirable extra padding and chafe protection between the rider and the spreader bar/hook assembly.

In use, the spreader bar/hook assembly extends across the front of the harness and each end of the spreader bar/hook assembly is attached to the harness in the vicinity of a respective hip of the rider, by an attachment means that generally permits some adjustment of the relative positions of the spreader bar/hook assembly and the harness, so as to accommodate physical differences between riders and differences in the other components of the kite assembly. The spreader bar is typically about 12" long and is intended to provide a comfortable load angle for the forces of the kite to be transferred to the hips of the rider.

The attachment means between the spreader bar/hook assembly and the harness may comprise webbing passing through an opening in the spreader bar and suitable securing means (such as buckles) and/or purpose-designed clips. In some harnesses, additional support for the spreader bar is provided by various support straps to secure and position the spreader bar, however these straps tend to increase the time required for a rider to put on and remove the harness.

The spreader hook is the point of connection between the harness and the power line of the kite. The power line of the kite is hooked to the spreader bar via the "trim loop". The spreader hook is made from a relatively strong material or materials, such as stainless steel or a suitable plastic. The actual hook used to connect with the trim loop typically protrudes out from the bar 2 to 3 inches and is in a C shape.

There are several methods to don a harness. Some riders loosen side buckles to release tension on the webbing, including webbing securing the spreader bar to the harness, which allows the rider to slide the harness over their legs and up to their waist. Some spreader bars feature clips or hook systems that enable the rider to disconnect the bar, however the webbing used to hold the harness secure must still be loosened before the latch or hook can be opened allowing the doff or don process.

It is common for a harness to include a grab handle, being a strong webbing handle, typically located at the back of the harness, which can be used by an assistant to help stabilize the rider while launching or landing a kite. Kite boarding instructors also use grab handles to stabilize students during lessons.

Use of propulsive wings and traction kites involves a number of risks. Pilot error as well as defects in material and design, can result in serious injuries and even death, as the forces produced by a kite can be significant. Loss of control of a kite by a rider and an associated inability of the rider to depower the kite, have resulted in very serious injuries and fatalities, including as caused by failures in the control bar and kite systems, lines tangling with the harness, partial immersion of harnesses at speeds resulting in the harness scooping water (referred to as bucketing), etc.

Efforts have been made in the kite board industry to improve the safety of the kite control bars and kites, and to provide means to reduce the power of the kite in an emergency. For example, responsive to the danger of line tangles, many kite-specific harnesses come fitted with a safety knife attached to the harness in an easy to reach location.

Further, many harnesses and kite assemblies include means for releasing the power line from the spreader hook.

The configuration of the spreader hook is important to the proper operation of kite release systems, as most such systems rely on a means for opening the trim loop so as to enable it to slide through the spreader hook. However, there have been serious accidents and fatalities due to the loops becoming jammed in the spreader hook when released, leaving the rider with no way to disengage from the power of the kite or to depower the kite. Alternate/backup configurations include spreader bars with hinging or releasing hooks that free the trim loop from the harness without opening the trim loop.

As a released kite poses potential danger to others downwind, to avoid losing a released kite, with such kite release means, it is standard practice to use a separate safety leash attached between the kite and a location on the harness separate from the spreader hook. With such leashes, to minimize the pulling force of the kite on the rider, it is desirable that a depowering action be activated at the kite when the leash is loaded by tension between the kite and the harness.

It is not uncommon for riders to attach the kite leash to the grab handle. Some harnesses also feature a handle pass leash attachment line that runs across the back of the harness. Kite safety leashes are attached to these back locations to allow ease of certain maneuvers such as handle passes. However, when a released kite loads a kite leash attached to the back of a harness, it can spin the rider facing backwards, making it difficult or impossible to reach a safety release for the leash. As well, the harness of a rider being dragged backwards through the water by a leash, may bucket, that is, scoop water, resulting in greater drag resistance (and thus greater tension on the leash and less depowering effect on the kite) and possibly a tendency to submerge the rider. There have been injuries and fatalities related to riders being dragged by their kite leashes being unable to reach their kite leash release.

In some cases, the kite leash may be attached to the side of a harness or to the spreader bar (typically to a loop affixed to the spreader bar). Although such attachment locations avoid some of the potential problems associated with attaching a leash at the back of a harness, at times a kite and the associated lines can tangle during a release, making the desired depowering effect of the kite release system ineffective. Even a kite leash attached to the front of the harness within easy reach of the rider can become tangled, making it impossible for the rider to release or depower the kite, resulting in a potentially dangerous high-speed drag or lofting, and possibly undesirable bucketing.

SUMMARY OF THE INVENTION

The present invention is directed to providing a kite boarding harness that allows the rider to completely separate themselves from the harness, and therefore all connections between the kite and harness with a single force motion of a release.

The release may be located at various locations on the harness, and may be configured to be activated by a push, pull, twist or other motion. For example, the release may be a sliding cuff, push button, pull cord or other suitable configuration.

The release may be activated directly by the rider or remotely by a second party via wireless.

The single point of entry to secure the harness and quick release motion of the harness release incidentally ease the donning and removal of the harness under normal use.

The release may be located on the spreader bar or within the padded body of the harness or incorporated into the webbing straps leading to the spreader bar. The release may be located within relatively easy reach of the rider on the side of the spreader bar or harness. The harness may have more than one release locations.

In use, when the release is activated, the spreader bar swings open due the pulling force of the kite. A load transfer loop (or loops or other similar fittings) is attached or connected between the harness waist belt and the spreader bar. When the load transfer loop comes under load from the pulling force of the kite it opens the conventional hook and loop fastener with which the waist belt is secured and/or releases any other restraints that hold the harness to the rider. The spreader bar may connected to any feature on the waist belt that may restrict it from coming away from the rider.

By activating this single release, the rider is freed from all attachments to the harness and its components. When released, the harness remains attached to kite via the trim loop or kite leash, or both, or any other attachment device used between the harness and kite/control bar assembly or attachment point to the propulsive wing outside the control bar.

The harness is preferably designed to assume a flat configuration when not in use around a rider, so as to reduce resistance (e.g., as caused by "bucketing") when the released harness is being dragged through the water.

The harness includes one or more vents (preferably covered in open mesh) or holes in the back of the harness to assist in reducing the profile and drag create by the released harness when dragged through the water. The vents may also provide lighter weight, improved comfort and flexibility and breathability.

The vents may also reduce the drag experienced by the rider during normal use, for example when the top edge of the harness "grabs" water during high speed crashes (for example in crash situations in breaking surf) or if the rider is pulled by the kite underwater. The vents allow water to pass through the harness if the rider is forced though the water at high speed.

The harness may include an overlay of mesh or fabric, to enclose the components of the harness so as to reduce the likelihood of a line becoming tangled in the harness. Preferably, the overlay is configured to permit access within the overlay to permit rider access to the components of the harness. The overlay may include a zipper to permit such access. The overlay may be configured to provide an integrated storage bag to carry a kite or other relevant equipment for the activity.

DETAILED DESCRIPTION WITH REFERENCE TO THE DRAWINGS

Figure 8:
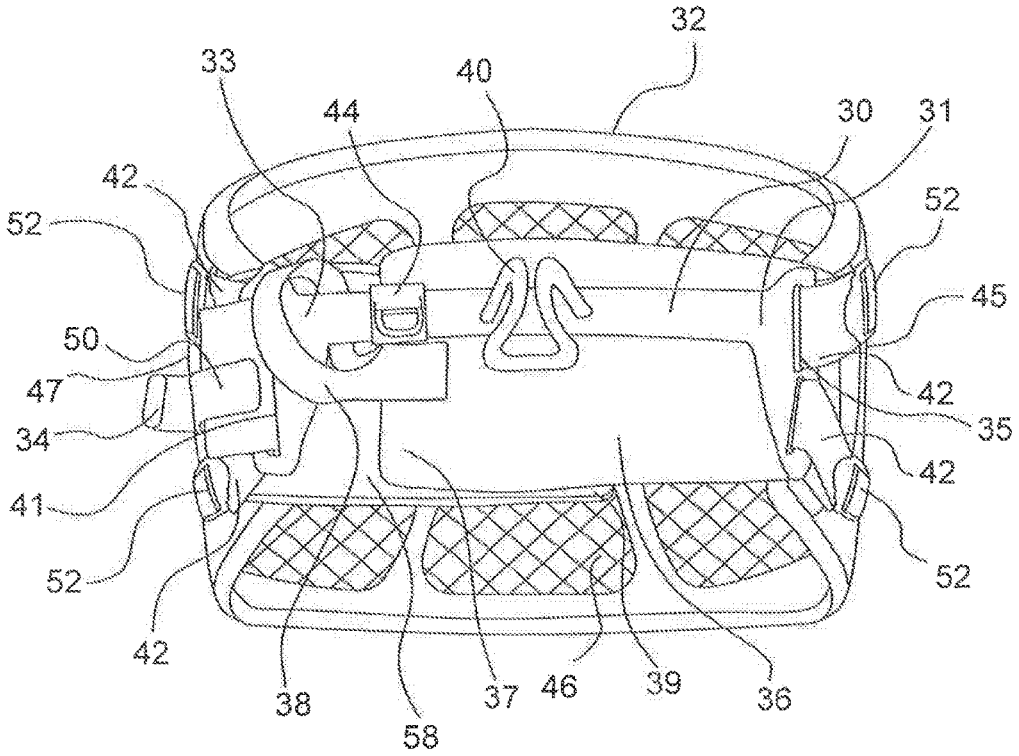
FIG. 8 is a front elevation view of a safety harness embodiment of the present invention.
Figure 9:
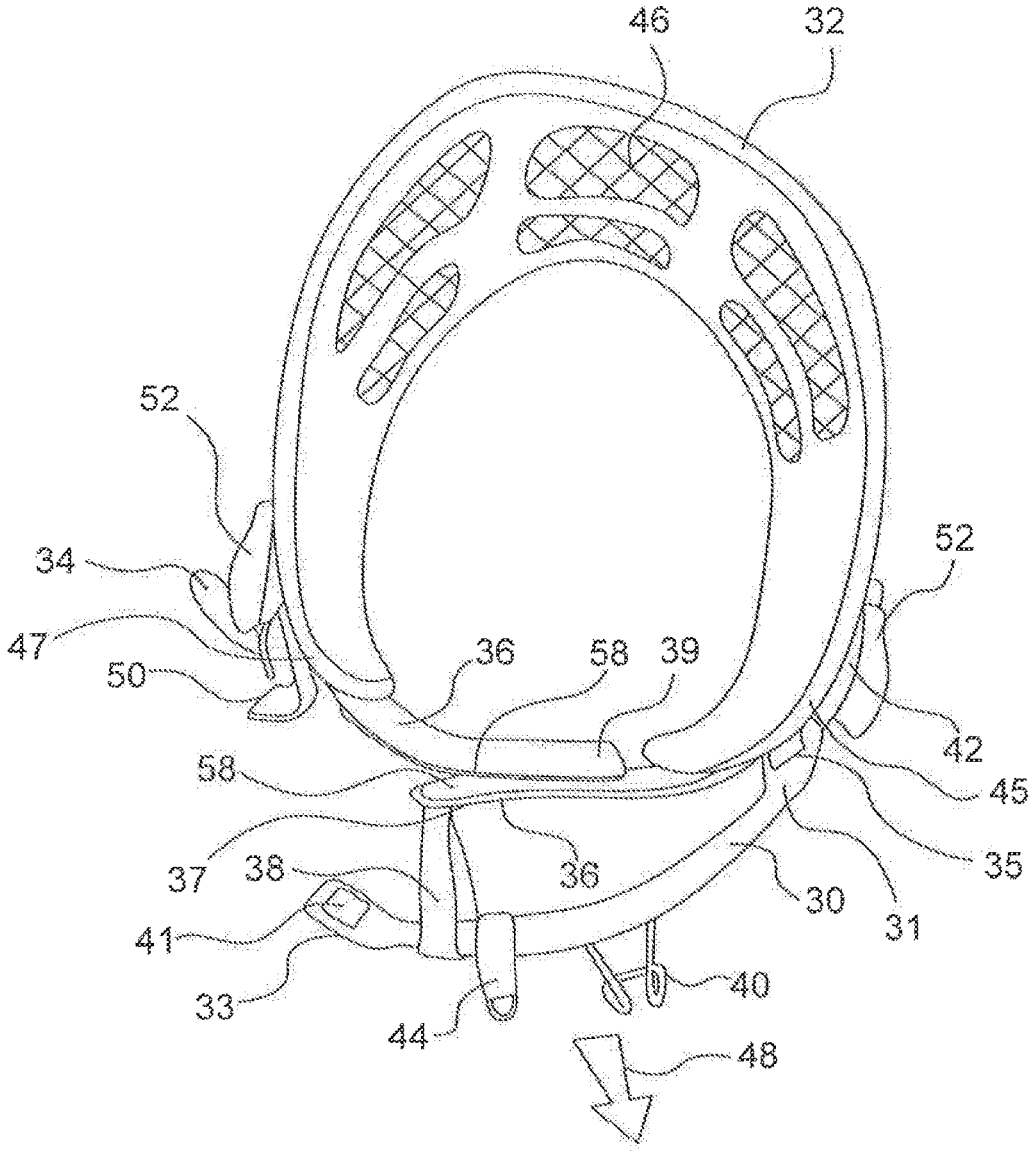
FIG. 9 is a top plan view of the safety harness of FIG. 8.

Referring to FIG. 8 and FIG. 9, components of the preferred embodiment of the invention are shown. The harness 32 has a waist belt 36 that overlaps itself and is held together with a two-part loop and hook fastener 58 (e.g., Velcro™). Waist belt 36 has a first end 37 and a second end 39

A spreader bar 30 is provided having a first end 31 and a second end 33. Spreader bar 30 has a first opening 35 at first end 31 and a second opening 41 at second end 33. The spreader bar 30 has a spreader bar hook 40 and a spreader bar leash attachment 44. First end 31 of spreader bar 30 is attached on a first side 45 of waist belt 36 and second end 33 of spreader bar 30 is secured on second side 47 of waist belt 36. First end 31 of the spreader bar 30 connects to the harness 32 by spreader bar attachment webbings 42 that are fed through the first opening 35 at first end of spreader bar 30 and secured with the webbing adjustment buckles 52 that are attached to the harness 32.

The second end 33 of the spreader bar 30 is attached to the harness 32 by a release 50 that connects to the harness 32 by spreader bar attachment webbings 42 that are fed through the webbing adjustment buckles 52 that are attached to the harness 32.

Figure 12:
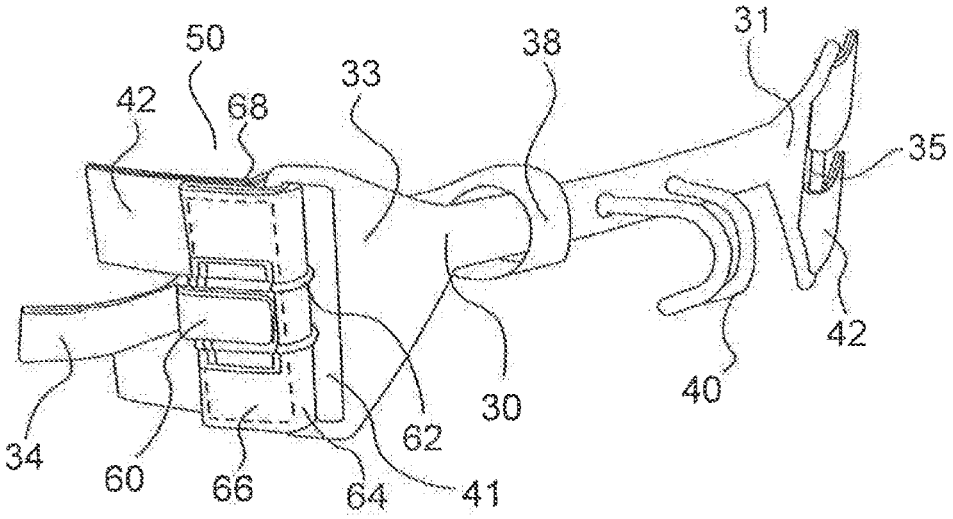
FIG. 12 is a perspective isolation view of the embodiment of the harness release of the present invention of FIG. 11, shown in the open/released position.

Referring to FIG. 12, the components of the release 50 are shown. On the side of the harness 32 that has the release 50, the two pieces of spreader bar attachment webbing 42 are connected to a webbing retainer 64. Sewn inside the webbing retainer 64 is a retainer plate 68 made from stainless steel material, or other non-deformable material (e.g., fiberglass, plastics) and a compression plate 66 made from stainless steel material, or other non-deformable material (e.g., fiberglass, plastics).

The section of the webbing retainer 64 that has the compression plate 66 is folded over the second opening 41 at the second end 33 of the spreader bar 30 and rests against the section of the webbing retainer 64 that has the retainer plate 68 inside. A U-shaped slider 60, made from stainless steel or similar, holds the compression plate 66 and the retainer plate 68 together, locking the end of the spreader bar 30 in place. The slider 60 is attached to the harness release tab 34 and two elastic cords 62 (e.g., shock cords) are attached at one end to the harness release tab, extend around the folded webbing retainer 64 and are affixed at the other end to the outer edge of the webbing retainer 64, past the compression plate 66. The tension provided by the elastic cord 62 assists in maintaining the slider 60 in the locked position.

Figure 13:
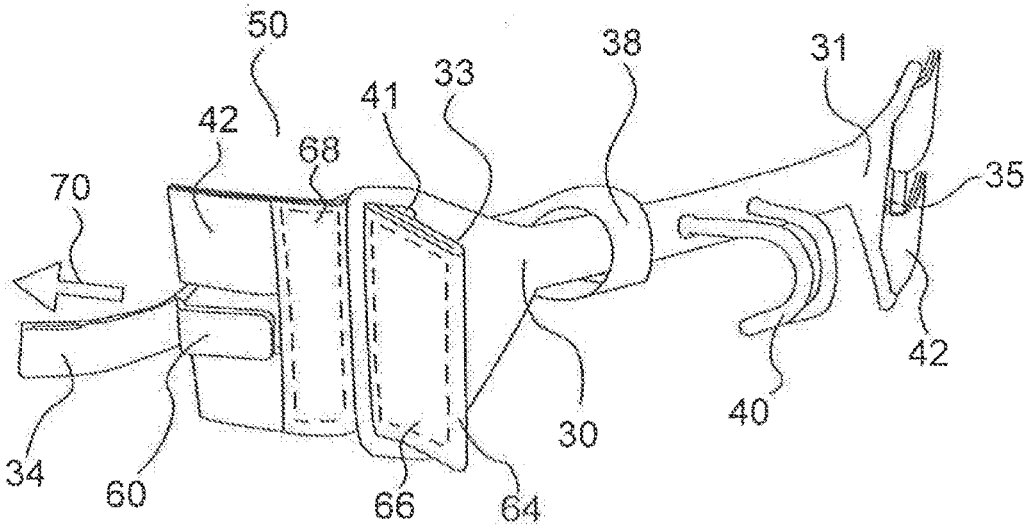
FIG. 13 is a perspective isolation view of the embodiment of the harness release of FIG. 12 showing the harness release tab being pulled in the direction of the release force to free the end of the spreader bar.

The release 50 is fitted with a harness release tab 34. Referring to FIG. 13, when the harness release tab 34 is pulled by the rider 10 in the direction of the release force 70, the elastic cord 62 is stretched and the end of the webbing retainer 64 that has the compression plate 66 inside folds open, away from the retainer plate 68, freeing the end of the spreader bar 30.

A load transfer loop 38 connects the releasable end of the spreader bar 30 to the outside end of the loop and hook fastener 58 overlap of the waist belt 36. As the end of the spreader bar 30 is released, the load on the spreader bar 30 is transferred to the load transfer loop 38. As is shown in FIG. 9, when in use there is a force 48 from the kite that pulls on the spreader bar 30 such that when the release 50 is activated by pulling the harness release tab 34, the released end of the spreader bar rotates away from the harness 32, which in turn pulls the load transfer loop 38, that connects the released end of the spreader bar 30 to the waist belt 36. The pull from the load transfer loop 38 peels the overlapping loop and hook fastener 58 section of the waist belt 36 open thus freeing the rider 10 completely of the harness 32 and thus frees the rider 10 completely from the propulsive force of the kite 14.

The harness 32 has mesh vents 46 that allow water to pass through the harness so that when the harness has been released and is being pulled by the kite 14, the harness will have reduced drag or resistance which will help to prevent the kite 14 from relaunching. As well, the vents 46 reduce the undesirable bucketing effect should the rider 10 be dragged in the water by the kite or when the harness 32 is partially immersed when the rider 10 is sailing in relatively extreme conditions.

Figure 10:
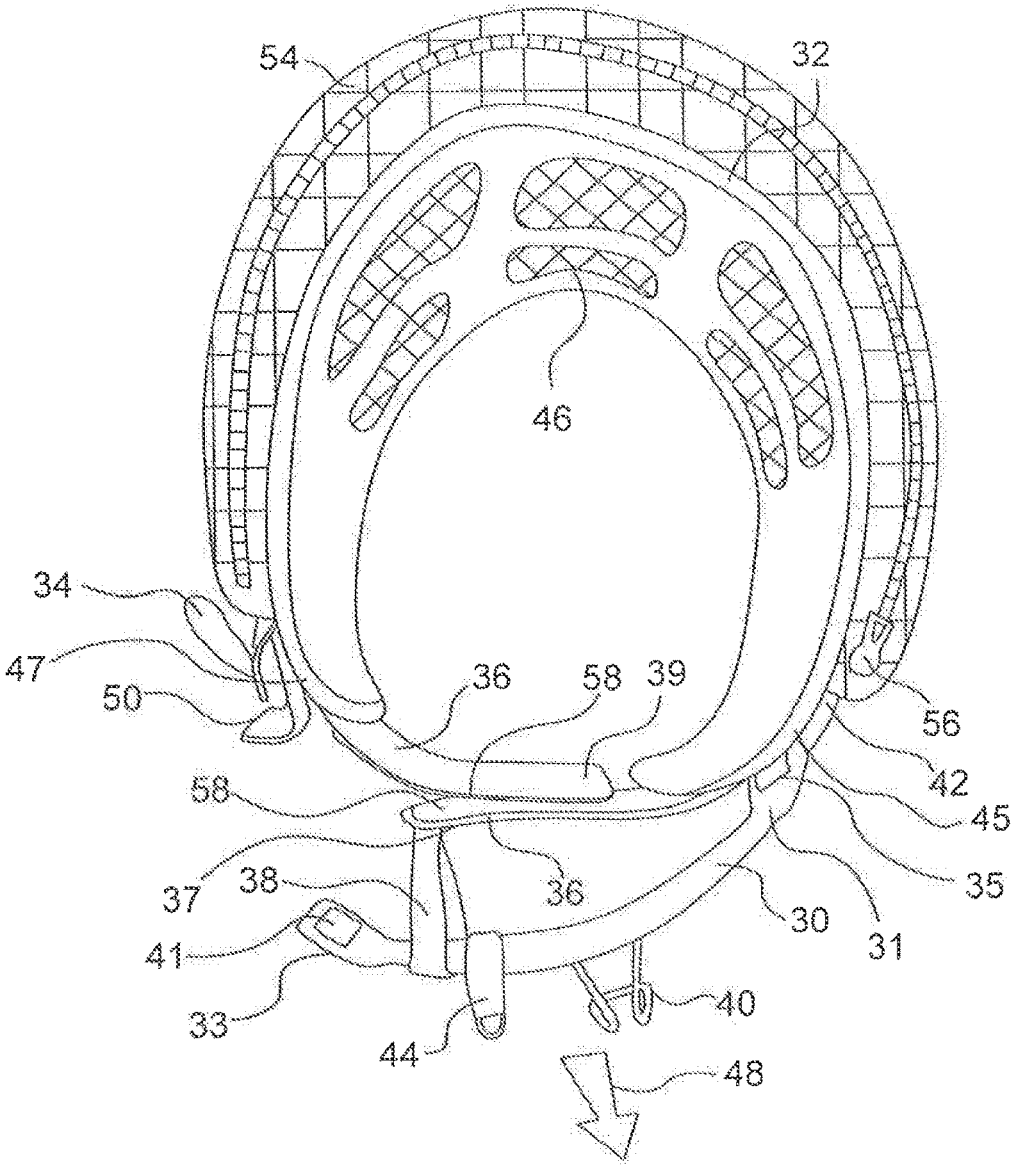
FIG. 10 is a top plan view of a safety harness embodiment of the present invention with a mesh/fabric overlay.
Figure 11:
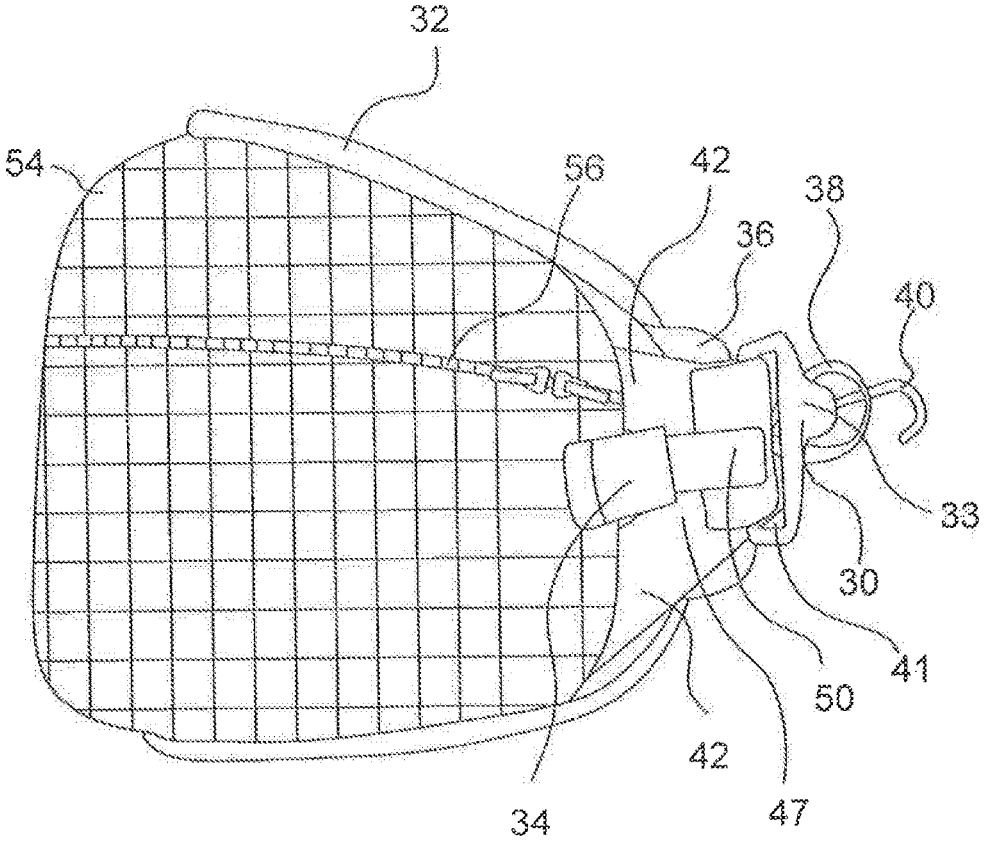
FIG. 11 is a perspective isolation view of an embodiment of the harness release of the present invention, shown in the closed position.

Referring to FIG. 10, a mesh fabric overlay 54 covers the sides and back of the harness 32 to cover locations where lines 16, 20 could tangle with the harness 32. The mesh fabric overlay 54 is fitted with a zipper 56 to permit access under the mesh fabric overlay 54.

Figure 1:
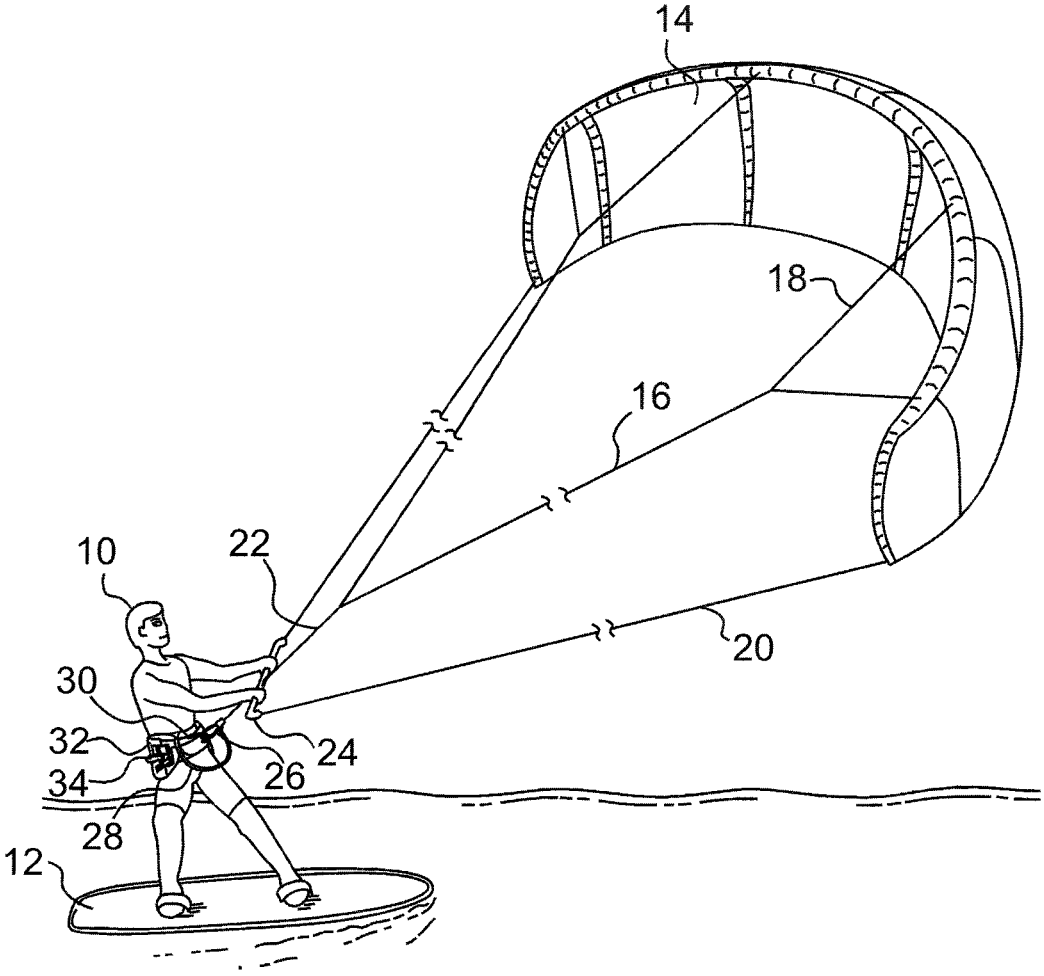
FIG. 1 is perspective view of a rider on a board using a kite attached to a safety harness embodiment of the present invention.

Referring to FIG. 1, a rider 10, stands on a board 12, and flies a kite 14. The propulsive force of the kite 14 is transferred to the rider 10 via bridles 18 that attach to the leading edge of the kite 14, and then attach to front lines 16 that connect to the trim line 22 (at times referred to herein as a power line), the trim line 22 passes through the kite bar 24 and terminates at a trim loop 26. The trim loop 26 is attached to the spreader bar 30, which is part of a harness 32 worn by the rider 10.

Rear lines 20 attach to the kite 14 at the wingtips and to the outer ends of the kite bar 24. Moving the kite bar 24 towards the rider 10 increases the angle of attack of the kite 14 thus increasing the propulsive force, while moving the kite bar 24 away from the rider lowers the angle of attack of the kite 14 thus reducing the propulsive force. Pulling on one side of the kite bar 24 causes the kite 14 to turn in that direction.

A kite leash 28 is connected to the trim loop 26 and then to the spreader bar 30. The kite leash 28 keeps the kite connected to the rider 10 when the trim loop 26 is no longer connected to the spreader bar 30.

There is a harness release tab 34, mounted on the harness 32, which when pulled releases the harness 32 completely from the rider 10.

In most instances, the assembly shown in the drawings and described herein would include a means (not shown) for releasing the trim loop 26 from the spreader bar hook 40.

Figure 2:
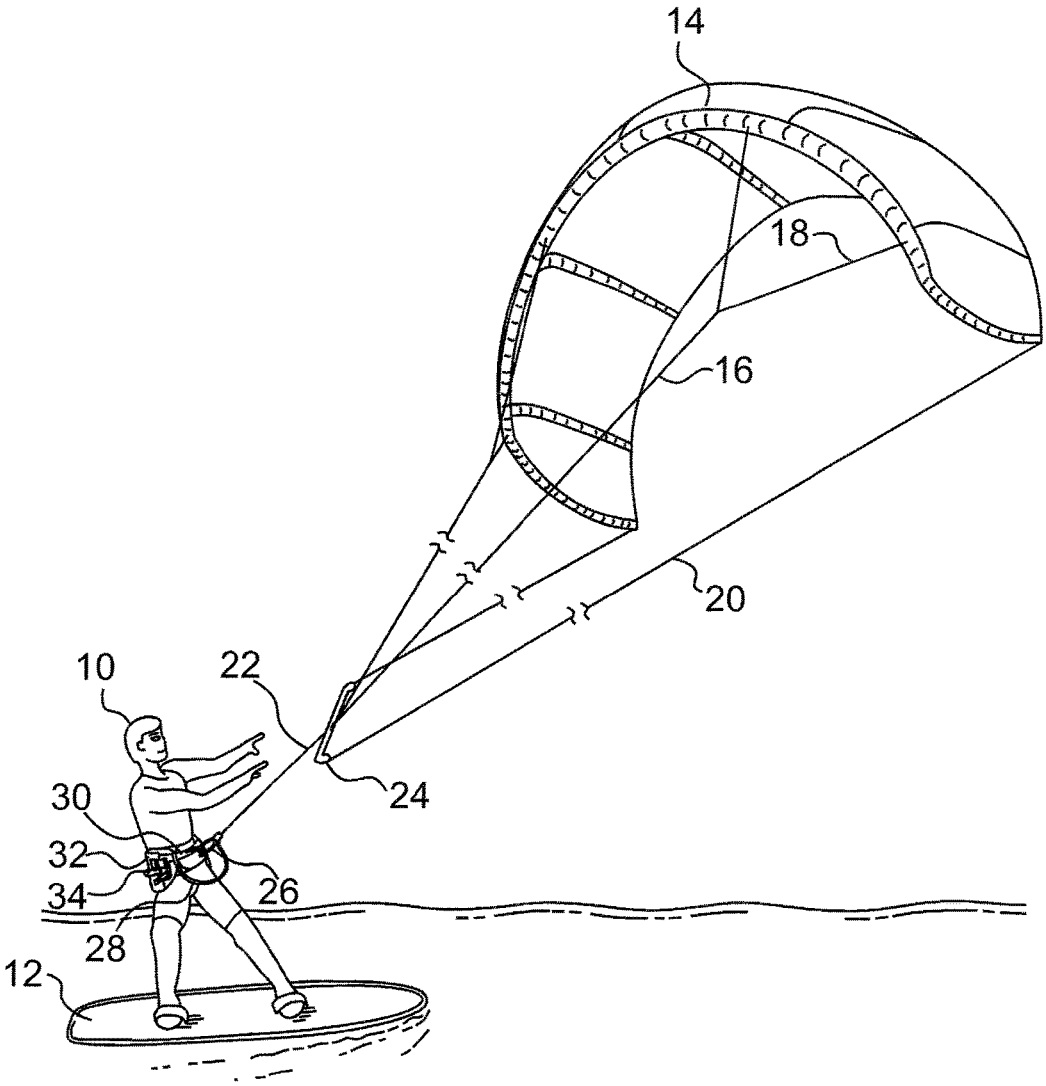
FIG. 2 is a perspective view of a rider on a board using a kite attached to the safety harness embodiment of FIG. 1 showing the rider releasing the kite.
Figure 3:
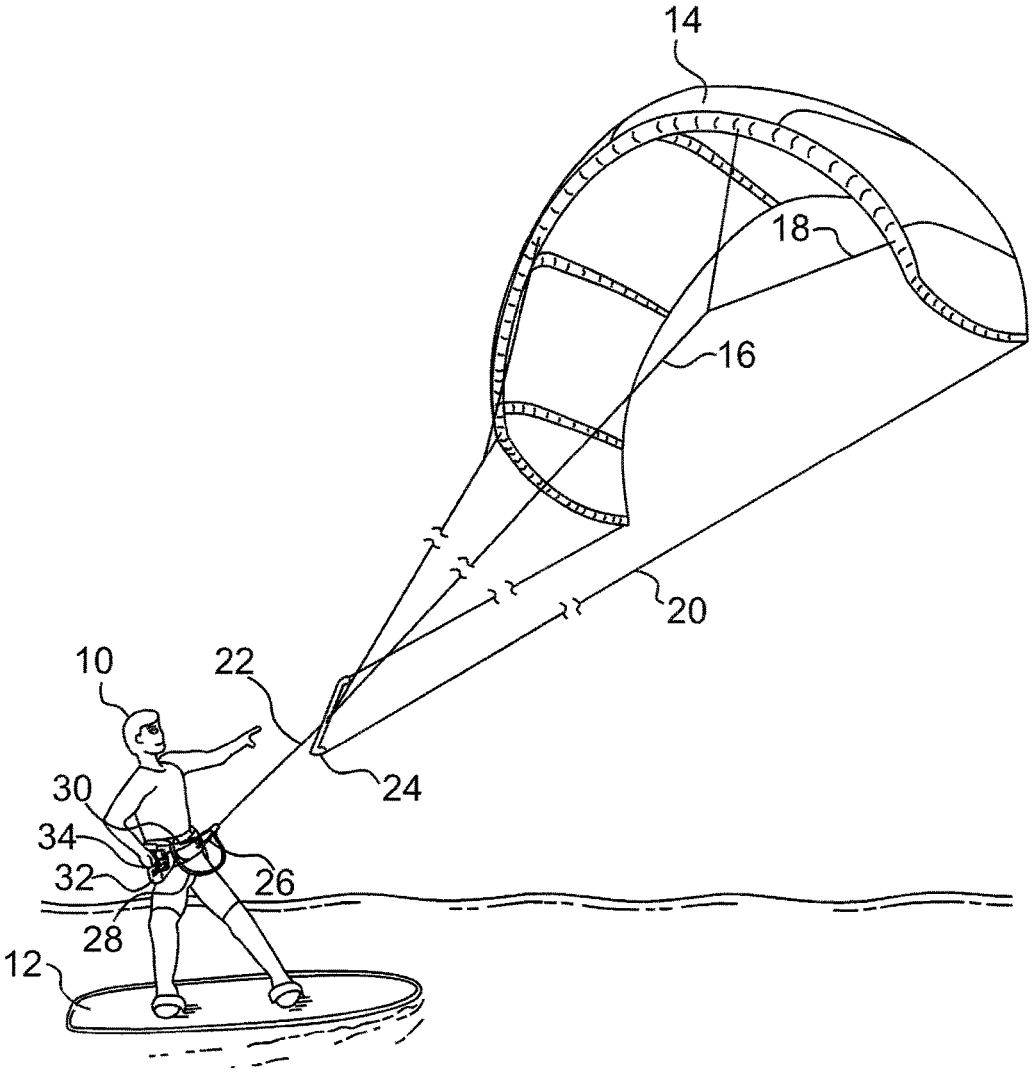
FIG. 3 is a perspective view of a rider on a board using a kite attached to the safety harness embodiment of FIG. 1, showing the kite bar released and the rider activating the harness release.
Figure 4:
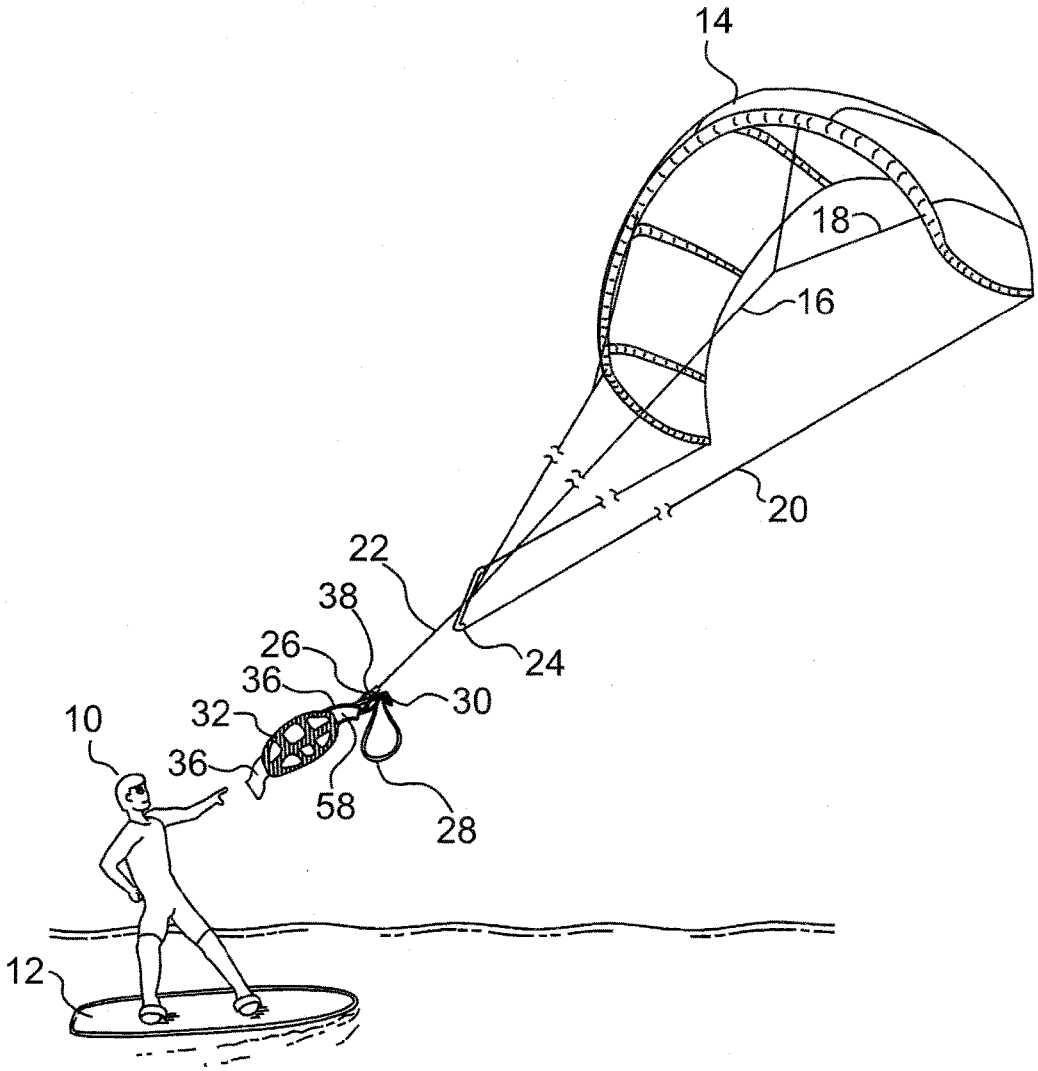
FIG. 4 is a perspective view of a rider on a board and the safety harness embodiment of FIG. 1, in which the rider has activated the harness release.

FIGS. 2, 3 and 4 illustrate the steps involved when a rider 10 desires to release himself from the propulsive force of the kite 14, and the rider is unable to release the trim loop 26 from the spreader bar hook 40.

Referring to FIG. 2, the rider 10 has released the rider's hold on the kite bar 24. This allows the kite bar 24 to move towards the kite 14, decreasing, but not eliminating the propulsive force of the kite.

Referring to FIG. 3, the rider 10 is pulling the harness release tab 34.

Referring to FIG. 4, the rider 10 has pulled the harness release tab 34 which releases one end of the spreader bar 30. The propulsive force of the kite 14, pulling on the spreader bar 30 via the trim loop 26, causes the released end of the spreader bar 30 to rotate away from the harness 32, which in turn pulls the load transfer loop 38, that connects the released end of the spreader bar 30 to the waist belt 36. The waist belt 36 wraps around the rider's 10 waist and has an overlapping loop and hook fastener 58 section that holds it in place. The pull from the load transfer loop 38 peels the overlapping loop and hook fastener 58 section of the waist belt 36 open thus freeing the rider 10 completely of the harness 32 and thus frees the rider 10 completely from the propulsive force of the kite 14.

Figure 5:
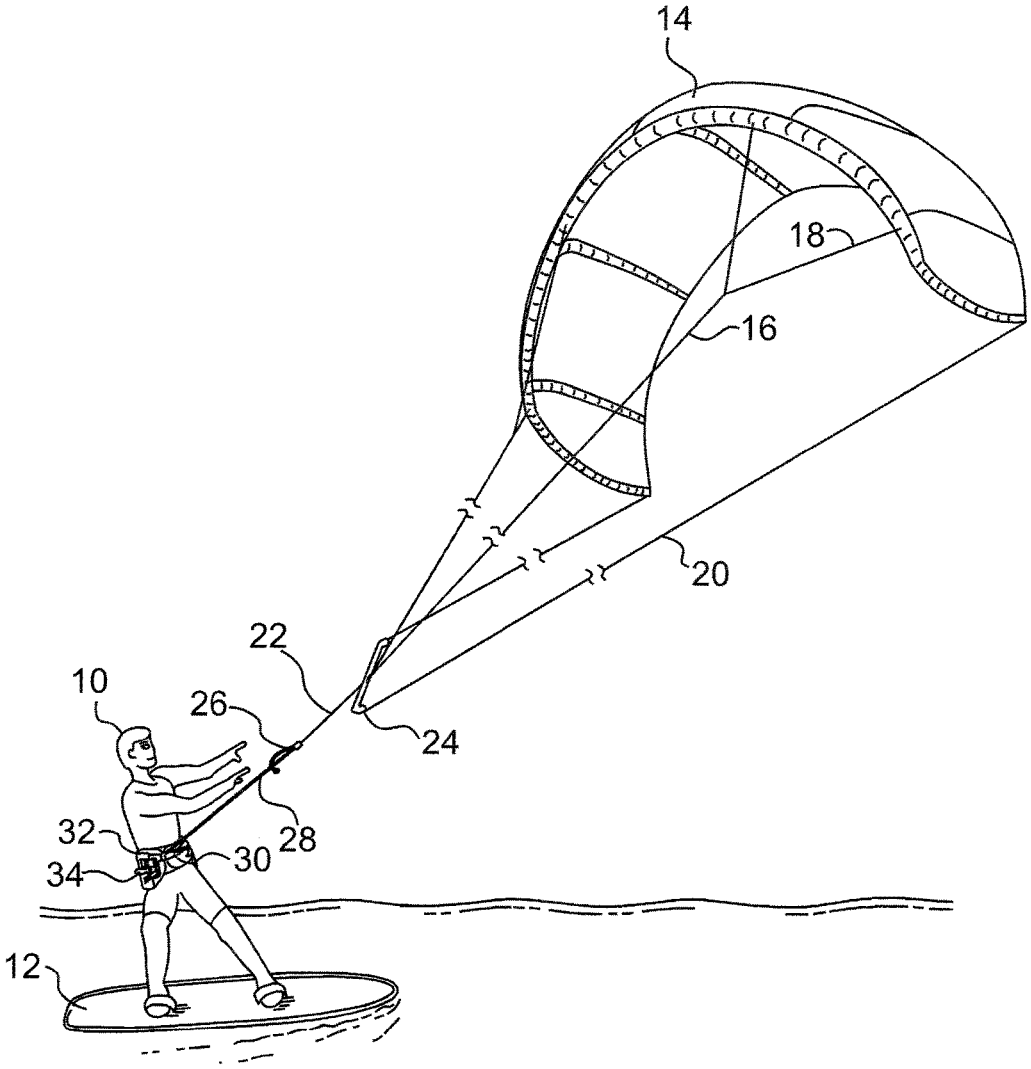
FIG. 5 is a perspective view of a rider on a board using a kite attached to a safety harness embodiment of the present invention, showing the rider releasing the trim loop so as to transfer the force the kite to the kite leash.
Figure 6:
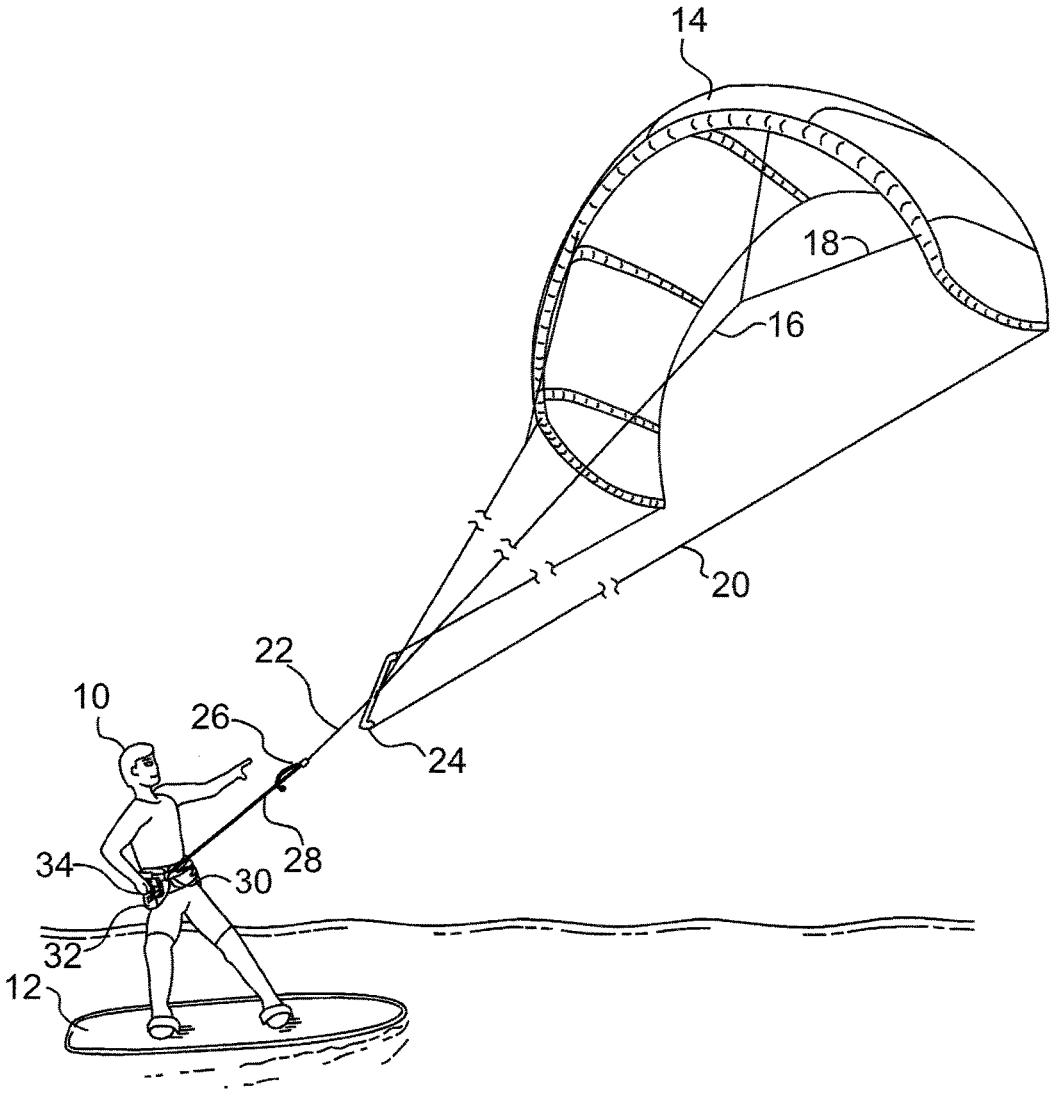
FIG. 6 is a perspective view of a rider on a board using a kite attached to the safety harness embodiment of FIG. 5, showing the trim loop released and the rider activating the harness release.
Figure 7:
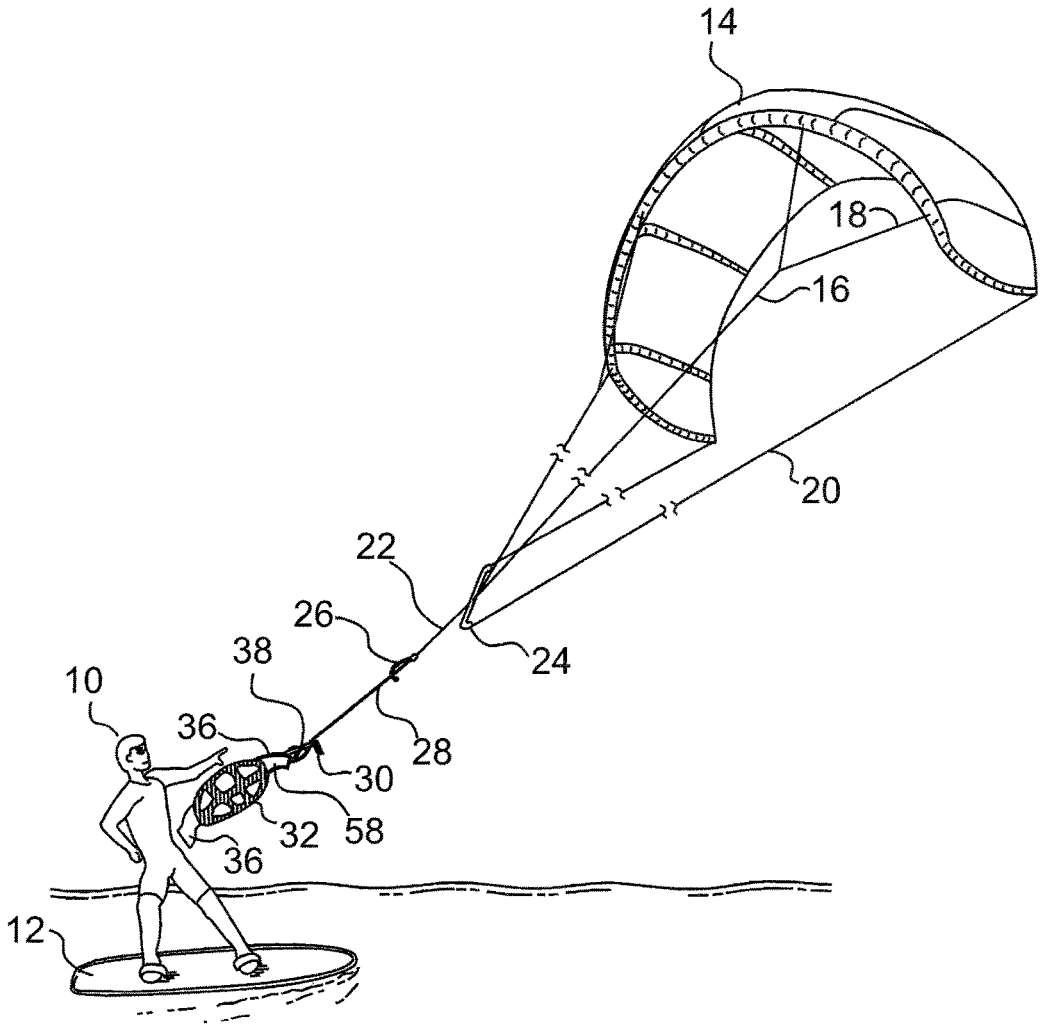
FIG. 7 is a perspective view of a rider on a board and the safety harness embodiment of FIG. 5, in which the rider has activated the harness release.

FIGS. 5, 6 and 7 illustrate the steps involved when a rider 10 has to release himself from the propulsive force of the kite 14 after they have activated the release on their trim loop 26 but are still connected to the kite 14 by the kite leash 28.

Referring to FIG. 5, the rider 10 has released the kite bar 24 with both hands and has activated the release on the trim loop 26 so the kite 14 is only attached to the harness 32 by the kite leash 28.

Referring to FIG. 6, the rider 10 is pulling the harness release tab 34.

Referring to FIG. 7, the rider 10 has pulled the harness release tab 34 which releases one end of the spreader bar 30. The propulsive force of the kite 14, pulling on kite leash 28 causes the released end of the spreader bar 30 to rotate away from the harness 32, which in turn pulls the load transfer loop 38, that connects the released end of the spreader bar 30 to the waist belt 36. The waist belt 36 wraps around the rider's 10 waist and has an overlapping loop and hook fastener 58 section that holds it in place. The pull from the load transfer loop 38 peels the overlapping loop and hook fastener 58 section of the waist belt 36 open thus freeing the rider 10 completely of the harness 32 and thus frees the rider 10 completely from the propulsive force of the kite 14.

The following terms and reference numbers are used herein and in the drawings: rider 10, board 12, kite 14, front lines 16, bridle 18, rear lines 20, trim line 22, kite bar 24, trim loop 26, kite leash 28, spreader bar 30, harness 32, harness release tab 34, waist belt 36, load transfer loop 38, spreader bar hook 40, spreader bar attachment webbing 42, spreader bar leash attachment 44, mesh ports 46, direction of force from kite 48, release 50, webbing adjustment buckle 52, mesh fabric overlay 54, zipper 56, loop and hook fastener 58, slider 60, shock cord 62, webbing retainer 64, compression plate 66, retainer plate 68, and release force 70.

What is claimed is:

1. A sport harness assembly comprising:

a harness;

a waist belt for securing the harness to a person, the waist belt having a first end and a second end, the first end of the waist belt is detachably secured to the second end of the waist belt until a force, is exerted sufficient to cause the first end of the waist belt to detach from the second end of the waist belt;

a spreader bar having a first end and a second end, the first end of the spreader bar is attached to the harness, and the second end of the spreader bar is attached via a release that is activated by pulling a harness release tab; and a load transfer loop connecting the spreader bar and the first end of the waist belt, when the release securing the second end of the spreader bar is released, the second end of the spreader bar rotates away from the harness and pulls the load transfer loop thereby detaching the first end of the waist belt from the second end of the waist belt to open the waist belt.

2. The sport harness of claim 1, wherein the first end of the waist belt is secured to the second end of the waist belt by mating hook and loop fasteners.

3. The sport harness of claim 1, wherein the spreader bar has a hook for making connections.

4. The sport harness of claim 1, wherein the first end of the spreader bar is attached by a webbing attached to the waist belt, the webbing passes through a first opening at the first end of the spreader bar and is secured by a webbing adjustment buckle.

5. The sport harness of claim 1, wherein the release comprises a U-shaped slider that holds a compression plate and retainer plate together, tension provided by an elastic cord maintains the slider in a locked position, and pulling upon the harness release tab stretches the elastic cord and releases the U-shaped slider to free the second end of the spreader bar.

6. The sport harness of claim 1, wherein the harness has vents.

7. The sport harness of claim 1, wherein the harness has a mesh fabric overlay.

8. The sport harness of claim 7, wherein the mesh fabric overlay is fitted with a zipper to permit access under the mesh fabric overlay.

* * * * *